US012339056B2

(12) United States Patent
Shitara

(10) Patent No.: US 12,339,056 B2
(45) Date of Patent: Jun. 24, 2025

(54) REFRIGERATOR

(71) Applicants: HAIER SMART HOME CO., LTD., Qingdao (CN); QINGDAO HAIER REFRIGERATOR CO., LTD., Qingdao (CN); AQUA CO., LTD., Tokyo (JP)

(72) Inventor: Shinsuke Shitara, Tokyo (JP)

(73) Assignees: HAIER SMART HOME CO., LTD., Qingdao (CN); QINGDAO HAIER REFRIGERATOR CO., LTD., Qingdao (CN); AQUA CO., LTD., Tokyo (JP)

( * ) Notice: Subject to any disclaimer, the term of this patent is extended or adjusted under 35 U.S.C. 154(b) by 94 days.

(21) Appl. No.: 18/023,723

(22) PCT Filed: Aug. 30, 2021

(86) PCT No.: PCT/CN2021/115376
§ 371 (c)(1),
(2) Date: Feb. 27, 2023

(87) PCT Pub. No.: WO2022/042725
PCT Pub. Date: Mar. 3, 2022

(65) Prior Publication Data

US 2023/0341171 A1 Oct. 26, 2023

(30) Foreign Application Priority Data

Aug. 31, 2020 (JP) ..... 2020-146170

(51) Int. Cl.
*F25D 23/02* (2006.01)

(52) U.S. Cl.
CPC ..... *F25D 23/028* (2013.01); *F25D 23/02* (2013.01); *F25D 2323/021* (2013.01); *F25D 2400/06* (2013.01)

(58) Field of Classification Search
CPC ..... F25D 23/02; F25D 23/028; F25D 23/087; F25D 2323/021; F25D 2400/06
See application file for complete search history.

(56) References Cited

U.S. PATENT DOCUMENTS 7,008,032 B2 * 3/2006 Chekal ..... F25D 23/02 49/316
9,134,062 B2 * 9/2015 Jung ..... F25D 23/087
(Continued)

FOREIGN PATENT DOCUMENTS

CN 101135531 A 3/2008
CN 101865592 A 10/2010
(Continued)

*Primary Examiner* — Kimberley S Wright
(74) *Attorney, Agent, or Firm* — Cheng-Ju Chiang

(57) ABSTRACT

The present invention provides a refrigerator. The refrigerator has side-by-side doors including a first door and a second door, the first door has a rotatably provided middle post which has a locking mechanism for preventing rotation of the middle post, the locking mechanism has a release mechanism for releasing locking, the middle post is switched between a first position where the middle post is located when the first door is opened and a second position where the middle post is located when the first door is closed by opening and closing the first door, and the locking mechanism is released by the release mechanism during rotation from the first position to the second position; the locking mechanism has a projecting portion, and the projecting portion reduces an amount of rotation of the middle post when the middle post is in the first position and the release mechanism is not released.

7 Claims, 5 Drawing Sheets

(56) References Cited

U.S. PATENT DOCUMENTS

| | | | | |
|---|---|---|---|---|
| 10,458,698 | B2 * | 10/2019 | Ham | F25D 23/087 |
| 10,753,672 | B2 * | 8/2020 | Ham | F25D 23/087 |
| 10,837,695 | B2 * | 11/2020 | Baum | B67D 1/0857 |
| 10,907,880 | B2 * | 2/2021 | Avhale | F25D 21/04 |
| 11,359,856 | B2 * | 6/2022 | Park | E05B 65/0042 |
| 11,709,012 | B2 * | 7/2023 | Park | F25D 23/025 312/262 |
| 2005/0046319 | A1 * | 3/2005 | Chekal | F25D 23/02 312/401 |
| 2014/0159560 | A1 * | 6/2014 | Jung | F25D 23/02 312/405 |
| 2016/0178267 | A1 * | 6/2016 | Hao | F25D 23/02 312/405 |
| 2018/0209209 | A1 * | 7/2018 | Ham | E06B 7/215 |
| 2019/0170427 | A1 * | 6/2019 | Baum | F25D 23/02 |
| 2020/0011591 | A1 * | 1/2020 | Ham | F25D 23/02 |
| 2020/0191464 | A1 * | 6/2020 | Avhale | F25D 23/028 |
| 2020/0363122 | A1 * | 11/2020 | Park | F25D 23/025 |
| 2021/0063078 | A1 * | 3/2021 | Ayyawar | F25D 23/028 |
| 2022/0268510 | A1 * | 8/2022 | Park | F25D 23/025 |
| 2023/0375251 | A1 * | 11/2023 | Lyu | F25D 23/028 |
| 2024/0142160 | A1 * | 5/2024 | Alanis | F25D 23/02 |

FOREIGN PATENT DOCUMENTS

| | | | | |
|---|---|---|---|---|
| CN | 103185441 | A | | 7/2013 |
| CN | 104776676 | A | | 7/2015 |
| CN | 206469575 | U | | 9/2017 |
| CN | 107664374 | A | | 2/2018 |
| CN | 208901713 | U | * | 5/2019 |
| JP | 2019-7728 | A | | 1/2019 |

* cited by examiner

REFRIGERATOR

CROSS REFERENCE TO RELATED APPLICATIONS

The present invention is a 35 U.S.C. § 371 National Phase conversion of International (PCT) Patent Application No. PCT/CN2021/115376, filed on Aug. 30, 2021, which claims benefit of Japanese Application No. 2020-146170, filed on Aug. 31, 2020, the disclosure of which is incorporated by reference herein. The PCT International Patent Application was filed and published in Chinese.

TECHNICAL FIELD

The present invention relates to a refrigerator, and in particular, to a refrigerator with side-by-side doors.

BACKGROUND

In recent years, a storage capacity of a refrigerator is required to be increased, and a size of the refrigerator is increased accordingly. In a large refrigerator, when one door is provided, the door is heavy and large, and thus, inconvenience is generated in use. Therefore, in the large refrigerator, side-by-side doors (so-called French doors) become a mainstream.

For example, in Japanese publication No. 2019-7728 (patent document 1), a refrigerator is described, in which a middle post is provided in one of side-by-side doors, so as to close a gap between the side-by-side doors.

Prior Art Document

Patent Document

Patent document 1: Japanese publication No. 2019-7728.

SUMMARY

Problem to be Solved by Invention

Generally, for convenience, the refrigerator having the middle post as described in patent document 1 is configured such that one door can be opened and closed while the other door is closed. In this case, since the middle post is required to be moved to a specified position when the door having the middle post is closed, a force required to close the door tends to be larger compared with a case where the middle post is not provided.

However, when a force required to move the middle post is reduced, the middle post may move when the door is closed, is not fixed at the specified position when the door is closed, and thus may interfere with a refrigerator body or the other door.

Therefore, an object of the present invention is to provide a refrigerator which can reduce a force required to close a door and can hold a required position when the door is closed.

Solution to Problem

A refrigerator according to the present invention has side-by-side doors including a first door and a second door, the first door has a rotatably provided middle post, the middle post has a locking mechanism for preventing rotation of the middle post, the locking mechanism has a release mechanism for releasing locking, the middle post is switched between a first position where the middle post is located when the first door is opened and a second position where the middle post is located when the first door is closed by opening and closing the first door, and the locking mechanism is released by the release mechanism during rotation from the first position to the second position, thus performing switching; the locking mechanism has a projecting portion, and the projecting portion reduces an amount of rotation of the middle post when the middle post is in the first position and the release mechanism is not released.

The present invention can provide the refrigerator in which the force required to close the door having the middle post is reduced, a specified position is kept when the door is opened, and interference with other components is avoided when the door is closed.

Furthermore, the locking mechanism may further have a post-side locking portion, the post-side locking portion comes into contact with a door-side locking portion provided on the first door when the middle post rotates, thereby preventing the rotation of the middle post; the projecting portion may be configured to extend to a gap between the post-side locking portion and the door-side locking portion.

According to the present invention, in the locking mechanism, the projecting portion which can be easily provided at the specified position can be formed. Thus, rotation of the first door can be easily and reliably prevented to keep the position of the middle post.

Furthermore, an upper corner of the projecting portion facing the door-side locking portion may have a chamfered shape.

According to the present invention, the upper corner has a shape reducing interference between the projecting portion and the door-side locking portion when the middle post is switched to the first position to return the release mechanism to the specified position (that is, when the release mechanism is returned to an unreleased state), or when the release mechanism is released to switch the middle post to the second position. Thus, the position of the middle post can be smoothly changed when the first door is opened or closed.

Effects of Invention

The present invention can provide the refrigerator which can reduce the force required to close the door and can hold the required position when the door is closed.

DETAILED DESCRIPTION

First Embodiment

Figure 1:
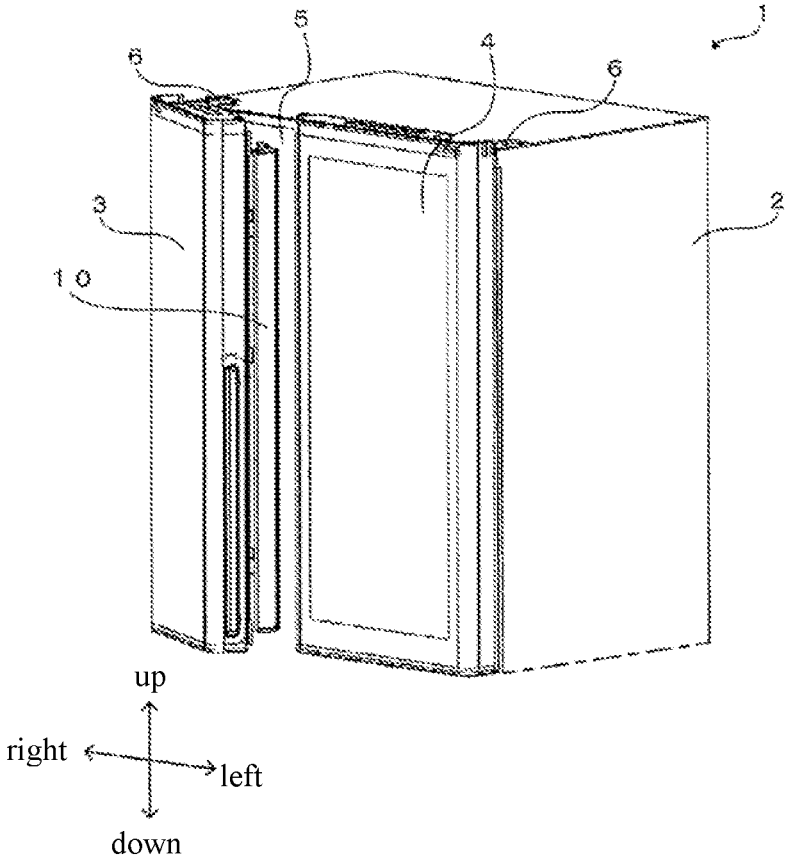
FIG. 1 shows a perspective view of an upper part of a refrigerator according to a first embodiment.

FIG. 1 is a perspective view of an upper part of a refrigerator according to a first embodiment of the present invention. In FIG. 1, a dotted line indicates a boundary between an illustrated part and an unillustrated part when a part of described components (in FIG. 1, a lower part of the refrigerator) is omitted. The same applies to other drawings. An outline of the refrigerator 1 according to the present invention is described with reference to FIG. 1. The refrigerator 1 has a refrigerator body 2, as well as a first door 3 and a second door 4 which are rotatably provided in a front part of the refrigerator body 2 in a horizontal direction. The first door 3 and the second door 4 are configured as side-by-side doors, and also referred to as French doors. The refrigerator body 2 has a storage chamber 5 accessible by opening the first door 3 or the second door 4.

In the present specification, a direction shown in FIG. 1 is defined as an up-down direction (vertical direction), a side where the first door 3 is present is defined as a right side, and a side where the second door 4 is present is defined as a left side. Furthermore, a side having the door relative to the storage chamber 5 is defined as a front side, and a side opposite to the door is defined as a rear side.

Upper portions and lower portions of the first door 3 and the second door 4 are connected to the refrigerator body 2 by hinges 6 provided at a right end of the first door 3 and a left end of the second door 4 respectively, and pivoting is performed about axes of the hinges. The first door 3 and the second door 4 are configured not to interfere with each other when the doors are opened and closed. That is, the first door 3 can be opened and closed in a state where the second door 4 is closed, and similarly, the second door 4 can be opened and closed in a state where the first door 3 is closed.

Figure 2:
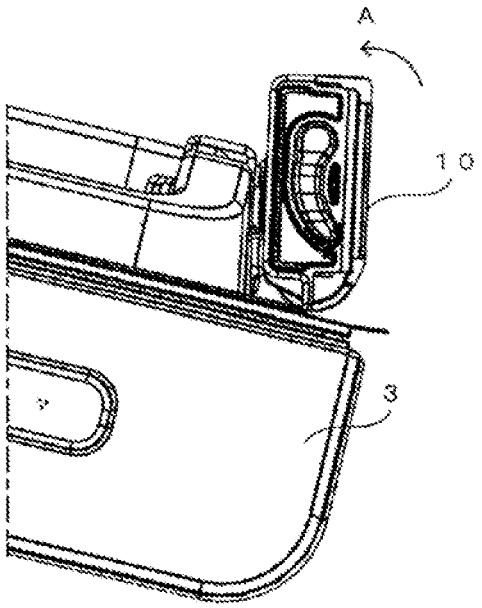
FIG. 2 shows a top view of a middle post in a state where a first door is opened.
Figure 3:
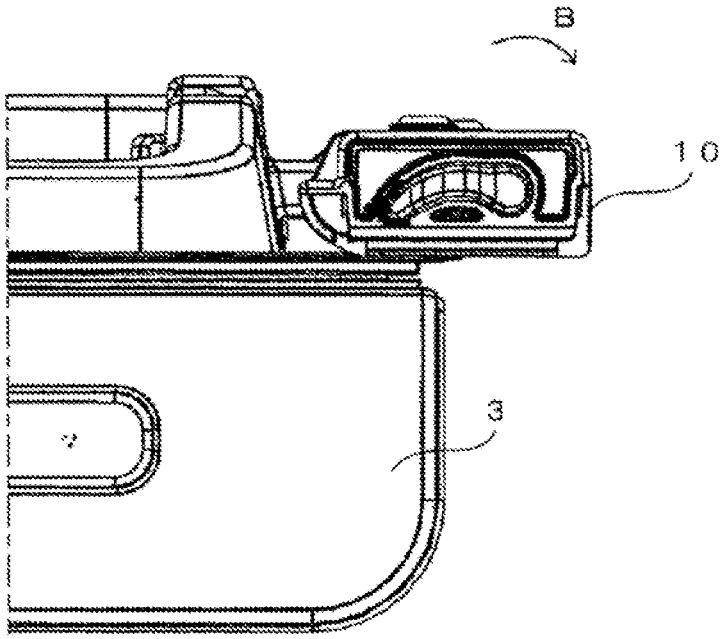
FIG. 3 shows a top view of the middle post in a state where the first door is closed.

The first door 3 has a middle post 10. The middle post 10 shields, for example, a gap possibly generated between the first door 3 and the second door 4, and thus can suppress a decrease in a cooling function. FIGS. 2 and 3 show top views of the middle post 10 in the state where the first door 3 is opened and the state where the first door 3 is closed respectively. As can be seen from FIGS. 2 and 3, the middle post 10 is mounted to be rotatable about a rotation axis relative to the first door 3.

As shown in FIG. 2, the middle post 10 has a cross section with a substantially-rectangular-parallelepiped elongated shape. When the first door 3 is opened, the middle post 10 is configured to allow a narrow surface to face the first door 3. Hereinafter, a position of the middle post 10 in the state where the first door 3 is opened is defined as a first position.

As described above, the first door 3 can be opened and closed even when the second door 4 is closed. Therefore, the middle post 10 is configured not to be in contact with the second door 4 even when the first door 3 is opened and closed when located at the first position.

As shown in FIG. 3, when the first door 3 is closed, the middle post 10 is configured to allow a wide surface to face the first door 3. Hereinafter, a position of the middle post 10 in the state where the first door 3 is closed is defined as a second position. The first position and the second position are configured to be switched by opening and closing the first door 3.

Figure 4:
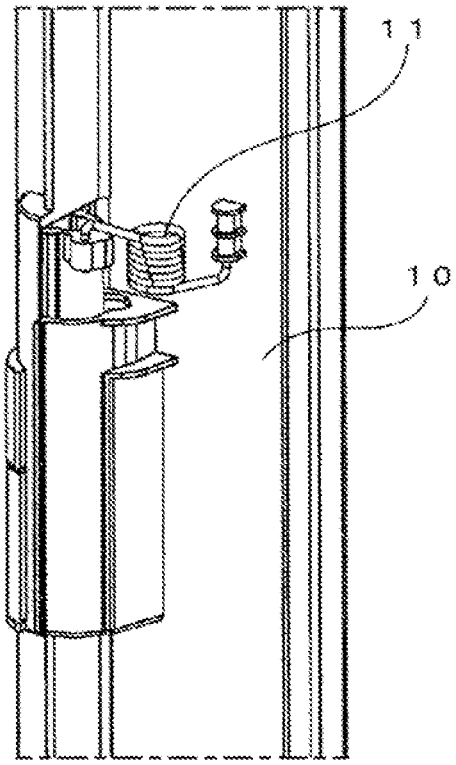
FIG. 4 shows a perspective view of a part of the interior of the middle post.

FIG. 4 shows a perspective view of the interior of the middle post 10 mounted to the first door 3. As shown in FIG. 4, in the present embodiment, the middle post 10 has a torsion spiral spring 11. One end of the torsion spiral spring 11 is rotatably mounted to the middle post 10, and the other end is rotatably mounted to a component fixed to the first door 3.

When the middle post 10 is located at the first position, the torsion spiral spring 11 applies a force in a direction of arrow A shown in FIG. 2, so as to keep the middle post 10 at the first position. When the middle post 10 is rotated from the first position to a specified position around the rotation axis, the torsion spiral spring 11 is reversed to apply a force in a direction of arrow B shown in FIG. 3, and the middle post 10 is rotated to and kept at the second position. Furthermore, in contrast to the above situation, when the middle post 10 is rotated from the second position to the specified position about the rotation axis, the torsion spiral spring 11 is reversed to apply a force in the direction of arrow A, and the middle post 10 is rotated to and kept at the first position.

Figure 5A:
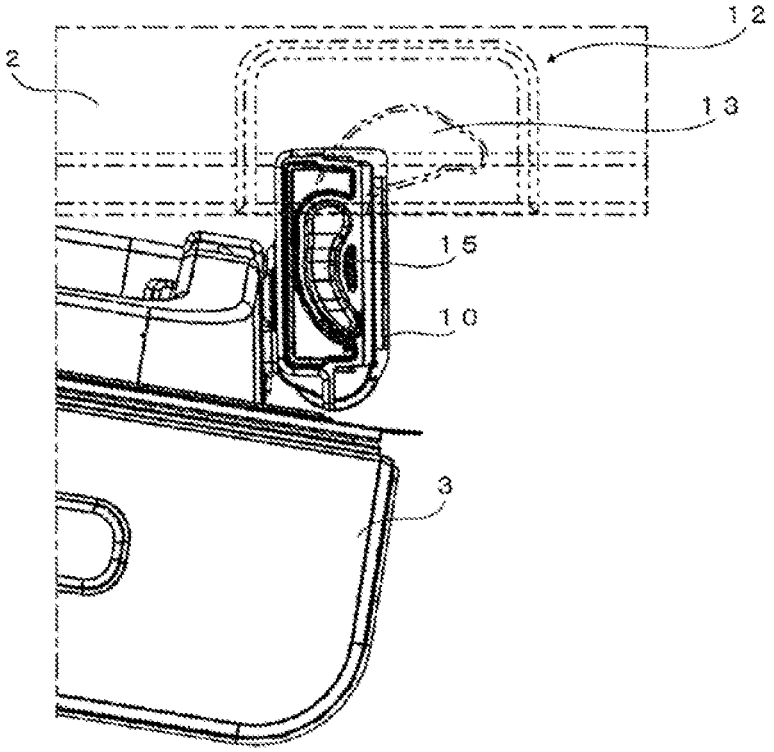
FIG. 5A shows a top view of the middle post slightly before the first door is closed.
Figure 5B:
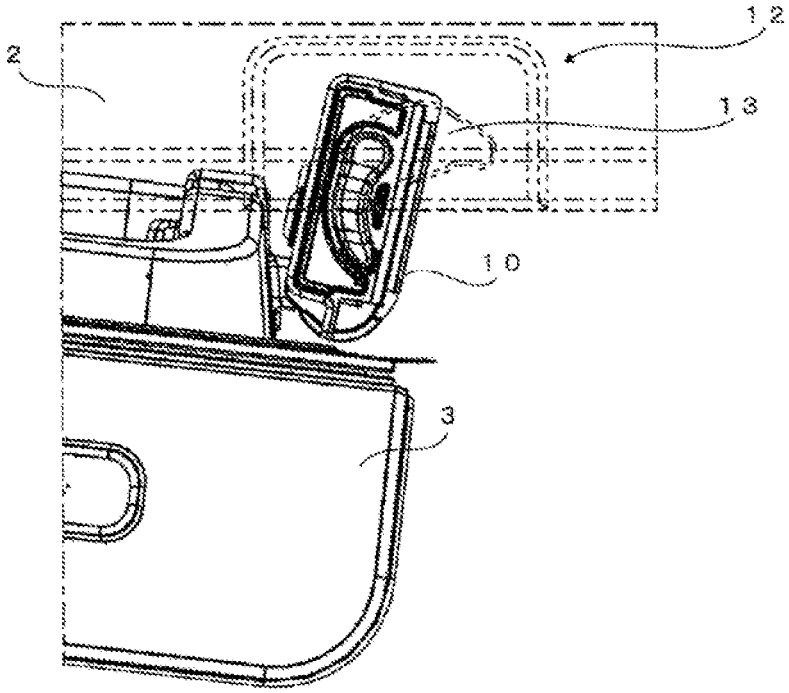
FIG. 5B shows a top view of the middle post rotating when the first door is closed.
Figure 5C:
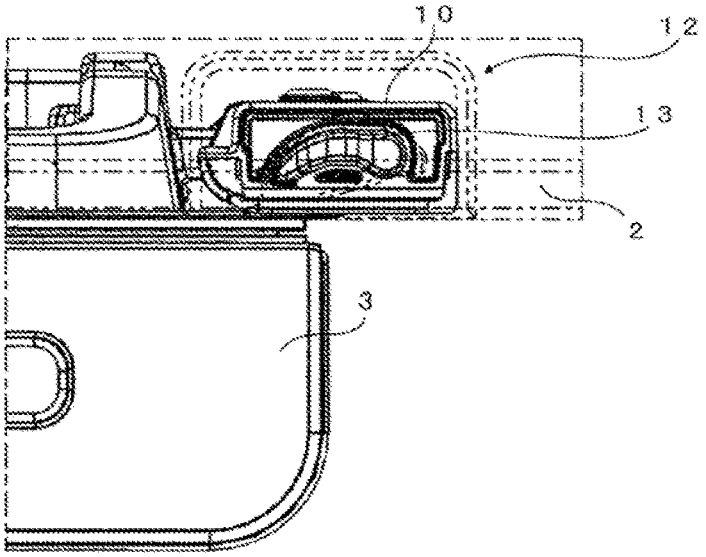
FIG. 5C shows a top view of the middle post in the state where the first door is closed.

FIGS. 5A to 5C show top views of the middle post 10 rotated from the first position to the second position when the first door 3 is closed. FIG. 5A shows a state where the middle post 10 is located at the first position before rotation. FIG. 5B shows a state where the middle post 10 is in the rotation process. FIG. 5C shows a state where the middle post 10 is fully rotated to be located at the second position. In FIGS. 5A to 5C, in order to clearly show the middle post 10, the refrigerator body 2, as well as a guide mechanism 12 and a guide groove 13 described later are schematically shown by imaginary lines (two-dot chain lines), and a situation where the middle post 10 is rotated with respect to the components is shown.

As shown in FIG. 5A, when the first door 3 is closed, the middle post 10 at the first position is engaged with the guide mechanism 12, and the guide mechanism 12 is mounted to an upper portion of the storage chamber 5 of the refrigerator body 2. As shown in FIGS. 5A to 5C, the guide mechanism 12 is provided therein with the guide groove 13, the guide groove 13 is shaped to guide an advancing direction of the middle post 10 as the first door 3 is closed, and the middle post is moved towards the storage chamber 5 of the refrigerator body 2. Thus, the middle post 10 is guided by the guide groove 13 of the guide mechanism 12 to rotate in the direction of arrow B as the first door 3 is closed, so as to get parallel to the first door 3, and the middle post is switched from the first position to the second position while rotating about the rotation axis.

When the first door 3 is opened, in contrast to the above situation, the middle post is guided by the guide mechanism 12 to rotate in the direction of arrow A, such that the narrow surface of the middle post 10 faces the first door 3, and the middle post is switched from the second position to the first position while rotating about the rotation axis. The middle post 10 is configured not to interfere with the second door 4 regardless of a position of the second door 4 (that is, no matter whether the second door 4 is opened or closed) when the first door 3 is opened and closed. Therefore, when opening and closing the first door 3 and the second door 4, a user cannot pay attention to an opening and closing order.

In this way, when the first door 3 is closed, the middle post 10 is configured to be at the second position, and thus, leakage of cold air from the gap possibly generated between the first door 3 and the second door 4 can be suppressed to suppress an increase in power consumption.

As described above, the middle post 10 is configured not to be in contact with the second door 4 when the first door 3 is opened and closed when located at the first position. However, in the state where the first door 3 is opened, when the middle post 10 is at the second position, the middle post 10 interferes with the second door 4. To prevent this situation, the middle post 10 has a release mechanism 14. The release mechanism 14 is configured to prevent the middle post 10 from rotating from the first position to the second position when the mechanism is not released. Thus, even when the user touches the middle post 10 when opening the first door 3 to use the refrigerator 1, the middle post 10 can be prevented from easily moving to the second position in the state where the first door 3 is opened.

Figure 6:
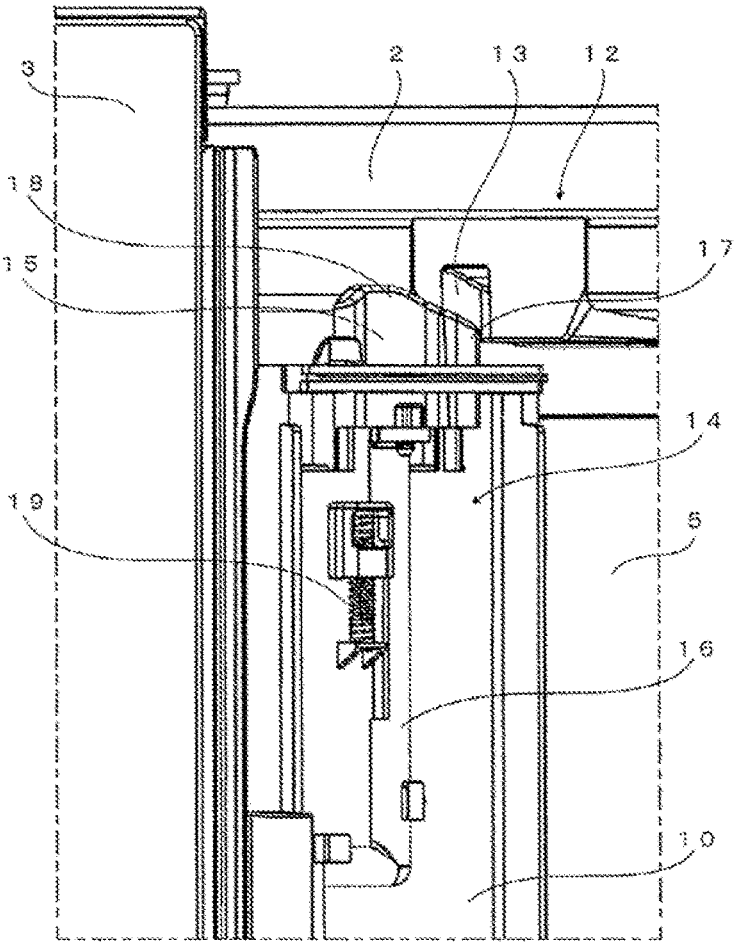
FIG. 6 shows a perspective view of a part of a middle post of the refrigerator according to the first embodiment.

FIG. 6 shows a perspective view of the interior of the middle post 10 of the first door 3 of the refrigerator 1 according to the present embodiment. As shown in FIG. 6, the release mechanism 14 has a vertically slidable protruding portion 15 provided to protrude to an upper portion of the middle post 10, and a guide portion 16 integrated with the protruding portion 15 to be slidable.

As for the engagement between the middle post 10 and the guide mechanism 12, specifically, the protruding portion 15 of the release mechanism 14 of the middle post 10 is engaged with the guide groove 13 of the guide mechanism 12. As shown in FIG. 6, the protruding portion 15 is formed such that a center portion 18 is vertically higher than a front end portion 17, and the front end portion 17 serves as a starting point for engagement with the guide groove 13. Therefore, by forming the guide groove 13 at a height at which the front end portion 17 can be inserted but the guide groove interferes with the center portion 18, the protruding portion 15 can be vertically pushed downwards to slide when the protruding portion 15 is engaged with the guide groove 13. Preferably, the guide groove 13 is formed in a shape which allows the protruding portion 15 to smoothly slide downwards when the middle post 10 is engaged with the guide mechanism 12.

The guide portion 16 is mounted to a compression coil spring 19, such that the protruding portion 15 can slide upwards when the aforementioned engagement is released (that is, when the first door 3 is opened). Thus, the protruding portion 15 can return to a specified position.

Figure 7:
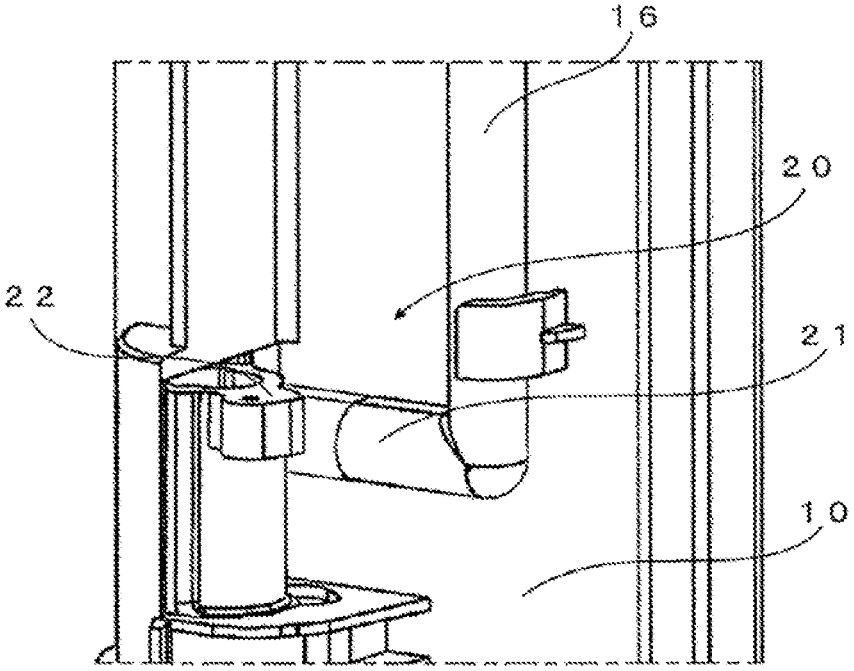
FIG. 7 shows a perspective view of a part of the middle post of the refrigerator according to the first embodiment.

Furthermore, the guide portion 16 has a locking mechanism 20, and when the middle post 10 is at the first position, the middle post 10 is prevented from rotating to the second position by the locking mechanism 20. FIG. 7 shows a perspective view of the interior of the middle post 10 of the first door 3 of the refrigerator 1 according to the present embodiment, showing the locking mechanism 20. The locking mechanism 20 has a post-side locking portion 21. The post-side locking portion 21 is configured to interfere with a door-side locking portion 22 provided on the first door 3 when the middle post 10 is rotated without sliding the protruding portion 15 downwards, thereby preventing the rotation. Furthermore, when the middle post 10 is engaged with the guide mechanism 12 (that is, when the protruding portion 15 is pushed downwards), the guide portion 16 slides downwards due to integration with the protruding portion, and thus, the post-side locking portion 21 moves downwards. When moving downwards, the post-side locking portion 21 does not interfere with the door-side locking portion 22, thereby realizing rotation.

In this way, in the refrigerator 1 according to the present embodiment, even when the user unintentionally touches the middle post 10, the middle post 10 can be prevented from rotating. Therefore, in the refrigerator with the side-by-side doors, even when one of the doors has the middle post 10, the doors can be opened and closed without considering the opening and closing order of the doors.

Second Embodiment

Figure 8:
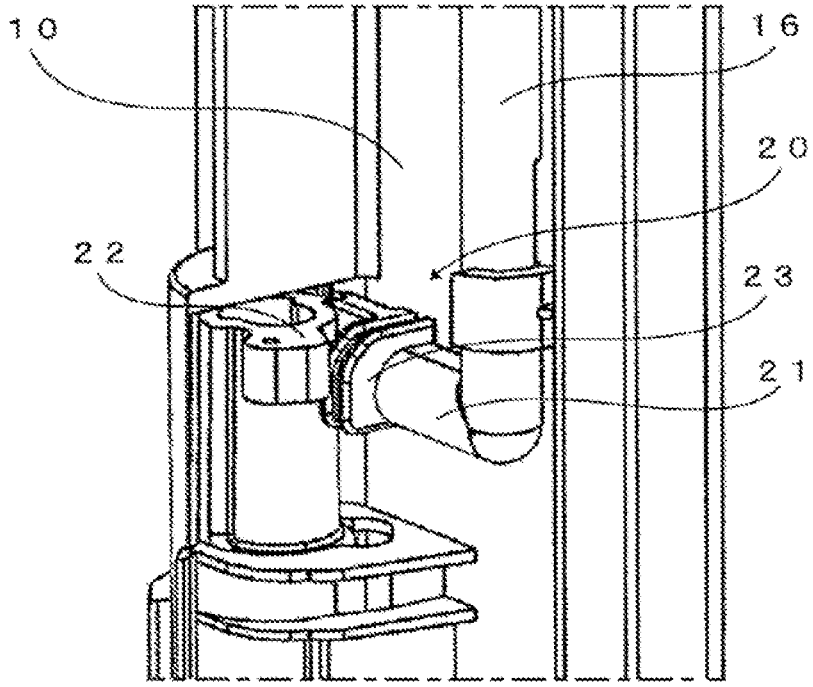
FIG. 8 shows a perspective view of a part of a middle post of a refrigerator according to a second embodiment.

FIG. 8 shows a perspective view of a locking mechanism 20 of a middle post 10 of a refrigerator 1 according to a second embodiment. As described above, the middle post 10 is switched from the first position to the second position by closing the first door 3. However, since the middle post 10 is kept at the first position by the torsion spiral spring 11 therein when the first door 3 is opened, stress is required to be applied to the torsion spiral spring 11 to deform the torsion spiral spring when the middle post is switched to the second position. Therefore, when a spring constant of the torsion spiral spring 11 is large, the force required to open and close the first door 3 is large.

As one of methods for reducing the force required for opening and closing the first door 3, a decrease in the spring constant is considered. For example, when the spring constant of the torsion spiral spring 11 is changed, such that a force required for reversing the spring is reduced by about 50%, the force required for closing the first door 3 (hereinafter, appropriately referred to as "door closing force") can be reduced by about 50%. Table 1 shows an example of changes in the door closing force measured at specified positions of a plurality of refrigerators, which are generated by changing the torsion spiral spring 11. When the torsion spiral spring 11 is changed to a spring in which the force required for reversal is reduced by about 50%, the door closing force can be reduced by about 45% on average, as shown in table 1.

TABLE 1

| No. | 1 | 2 | 3 |
|---|---|---|---|
| Before improvement (N) | 12.9 | 13.6 | 13.2 |
| After improvement (N) | 7.2 | 7.5 | 7.1 |

In this way, the door closing force can be reduced by reducing the spring constant of the torsion spiral spring 11. However, when the spring constant is decreased, the force for keeping the middle post 10 at the first position is decreased when the first door 3 is opened. When the keeping force is reduced, the position of the protruding portion 15 of the middle post 10 cannot be kept, and the middle post 10 may interfere with the guide mechanism 12 of the storage chamber 5 when the first door 3 is closed. For example, when the first door 3 is closed, the protruding portion 15 of the middle post 10 may not be engaged with the guide groove 13 but come into contact with other portions of the guide mechanism 12 than the guide groove 13, and the first door 3 may not be completely closed.

In order to prevent the above problem, in the present embodiment, as shown in FIG. 8, in the locking mechanism 20, a projecting portion 23 is provided in the post-side locking portion 21. The interference is caused by rotation of the post-side locking portion 21 in a gap between the post-side locking portion 21 and the door-side locking portion 22. When the gap has a size equal to or larger than a certain value, the post-side locking portion 21 rotates greatly, and the positions of the protruding portion 15 and the guide groove 13 do not coincide with each other. Therefore, by providing the projecting portion 23 in the post-side locking portion 21, the gap is reduced, an angle by which the middle post 10 can be rotated without releasing the release mechanism 14 can be reduced, and the above-described interference can be prevented.

The projecting portion 23 is formed to extend from the post-side locking portion 21 towards the door-side locking portion 22. Thus, the gap between the post-side locking portion 21 and the door-side locking portion 22 can be reduced.

In this way, by providing the projecting portion 23 in the post-side locking portion 21 serving as a part of the guide portion 16 used as one of the components of the middle post 10, the kept position of the middle post 10 can be adjusted by changing the guide portion 16 when required to be changed. Therefore, a number of components with shapes changed can be reduced. Furthermore, since the guide portion 16 is a relatively small component, the shape can be easily changed, and furthermore, an influence of the change in the shape on assembly can be reduced.

Preferably, the projecting portion 23 is formed of a plurality of protrusions. Thus, when the first door 3 is in the open state and the middle post 10 is at the first position, even when a force for rotating the middle post 10 towards the second position is applied, the projecting portion 23 can be prevented from being easily deformed.

When the middle post 10 is at the second position, the projecting portion 23 is located below the door-side locking portion 22. Then, when the middle post 10 is switched from the second position to the first position, the post-side locking portion 21 rotates while sliding relative to an upper portion of the projecting portion 23 and a lower portion of the door-side locking portion 22. Or, when the protruding portion 15 is engaged with the guide groove 13 and pushed downwards to rotate the middle post 10, the projecting portion 23 does not slide along with the door-side locking portion 22, and when the engagement between the protruding portion 15 and the guide groove 13 is released, the protruding portion 15 is released from downward pushing and slides upwards by the compression coil spring 19.

At this point, in the presence of interference, even when the middle post 10 is switched to the first position, the release mechanism 14 is kept released, and the protruding portion 15 may not smoothly return to the specified position; the interference is friction caused by contact between the door-side locking portion 22 and the projecting portion 23 slightly before the switching to the first position, or contact between the door-side locking portion 22 and the projecting portion 23 during sliding. In this case, the middle post 10 can be easily switched to the second position in the state where the first door 3 is opened. Furthermore, in the case of a shape in which the interference occurs, interference occurs also during switching from the first position to the second position, and when the first door 3 is closed, the release mechanism 14 is not normally released, and the first door 3 may not be closed. Therefore, the projecting portion 23 is preferably shaped to allow the release mechanism 14 to operate smoothly (that is, the release mechanism 14 is released smoothly, or the release of the release mechanism 14 is canceled smoothly). For example, as shown in FIG. 8, preferably, at least an upper corner facing the door-side locking portion 22 is chamfered. Thus, the above-described interference can be reduced, and smooth switching from the second position to the first position or from the first position to the second position can be allowed.

The present invention is not limited to the illustrated embodiments, and various improvements and design changes can be made without departing from the scope of the present invention.

INDUSTRIAL APPLICABILITY

As described above, the present invention can provide the refrigerator which can reduce the force required to close the door and can hold the required position when the door is closed, and therefore, the solution can be preferably applied to the industrial field of the refrigerator.

REFERENCE NUMERALS

1 refrigerator
2 refrigerator body
3 first door
4 second door
5 storage chamber
10 middle post
12 guide mechanism
13 guide groove
14 release mechanism
20 locking mechanism
21 post-side locking portion
22 door-side locking portion
23 projecting portion

What is claimed is:

1. A refrigerator, having side-by-side doors comprising a first door and a second door, wherein:

the first door has a rotatably provided middle post;

the middle post has a locking mechanism for preventing rotation of the middle post;

the locking mechanism has a release mechanism for releasing locking;

the middle post is switched between a first position where the middle post is located when the first door is opened and a second position where the middle post is located when the first door is closed by opening and closing the first door, and the locking mechanism is released by the release mechanism during rotation from the first position to the second position, thus performing switching;

the locking mechanism has a projecting portion, and the projecting portion reduces an amount of rotation of the middle post when the middle post is in the first position and the release mechanism is not released;

the locking mechanism further has a post-side locking portion;

the post-side locking portion comes into contact with a door-side locking portion provided on the first door when the middle post rotates, thereby preventing the rotation of the middle post;

the projecting portion is configured to extend from the post-side locking portion towards the door-side locking portion to reduce a gap between the post-side locking portion and the door-side locking portion;

the middle post is kept at the first position by a torsion spiral spring when the first door is opened.

2. The refrigerator according to claim 1, wherein an upper corner of the projecting portion facing the door-side locking portion has a chamfered shape.

3. The refrigerator according to claim 1, wherein the projecting portion is formed of a plurality of protrusions.

4. The refrigerator according to claim 1, wherein the projecting portion is located below the door-side locking portion when the middle post is at the second position, and the post-side locking portion rotates while sliding relative to an upper portion of the projecting portion and a lower portion of the door-side locking portion when the middle post is switched from the second position to the first position.

5. The refrigerator according to claim 1, wherein the refrigerator has a refrigerator body and a guide mechanism mounted to the refrigerator body, and when the middle post is engaged with the guide mechanism, the post-side locking portion moves downwards.

6. The refrigerator according to claim 5, wherein the guide mechanism is provided therein with a guide groove, the release mechanism has a vertically slidable protruding portion protruding to an upper portion of the middle post, and a guide portion integrated with the protruding portion to slide, the guide portion has the locking mechanism, and when the protruding portion is engaged with the guide groove, the protruding portion is pushed downwards, and the guide portion and the post-side locking portion move downwards.

7. The refrigerator according to claim 6, wherein the guide portion is mounted to a compression coil spring, and when the engagement between the protruding portion and the guide groove is released, the compression coil spring drives the guide portion and the protruding portion to slide upwards.

* * * * *